US009828704B2

(12) United States Patent
Goenka

(10) Patent No.: US 9,828,704 B2
(45) Date of Patent: Nov. 28, 2017

(54) TERRY ARTICLE WITH SYNTHETIC FILAMENT YARNS AND METHOD OF MAKING SAME

(71) Applicant: Welspun India Limited, Mumbai (IN)

(72) Inventor: Dipali Goenka, Mumbai (IN)

(73) Assignee: WELSPUN INDIA LIMITED, Mumbai (IN)

( * ) Notice: Subject to any disclaimer, the term of this patent is extended or adjusted under 35 U.S.C. 154(b) by 0 days.

(21) Appl. No.: 14/866,916

(22) Filed: Sep. 26, 2015

(65) Prior Publication Data

US 2017/0073858 A1 Mar. 16, 2017

(30) Foreign Application Priority Data

Sep. 10, 2015 (IN) ..... 3474/MUM/2015

(51) Int. Cl.

| | |
|---|---|
| ***D03D 39/22*** | (2006.01) |
| ***D03D 27/08*** | (2006.01) |
| ***D06B 3/00*** | (2006.01) |
| ***D06B 11/00*** | (2006.01) |

(52) U.S. Cl.
CPC ..... *D03D 27/08* (2013.01); *D06B 3/00* (2013.01); *D06B 11/00* (2013.01)

(58) Field of Classification Search
CPC ..... D03D 27/08; D03D 49/12; D03D 27/00; D03D 39/22
See application file for complete search history.

(56) References Cited

U.S. PATENT DOCUMENTS

| | | | | |
|---|---|---|---|---|
| 4,400,418 | A | 8/1983 | Takeda et al. | |
| 4,711,079 | A | 12/1987 | Newton et al. | |
| 4,721,134 | A * | 1/1988 | Dorman | D03D 39/223 139/102 |
| 4,860,530 | A | 8/1989 | Montgomery et al. | |

(Continued)

FOREIGN PATENT DOCUMENTS

| | | | |
|---|---|---|---|
| AU | 7573374 | A | 5/1976 |
| CN | 101161886 | A | 4/2008 |

(Continued)

OTHER PUBLICATIONS

"Complete Textile Glossary", Celanese Acetate LLC., © 2001, 3 pages.

(Continued)

*Primary Examiner* — Bobby Muromoto, Jr.
(74) *Attorney, Agent, or Firm* — Baker & Hostetler LLP

(57) ABSTRACT

A terry article includes a ground component including a plurality of ground warp yarns and a plurality of weft yarns, and a pile component disposed on at least one of a lower side and an upper side of the ground component. The pile component includes a first plurality of piles that extend away from the ground component along a vertical direction. The first plurality of piles are formed from a first set of pile yarns comprised of natural fibers and further define a first pile height. The pile component also includes a second plurality of piles that extend away from the ground component in the vertical direction. The second plurality of piles are formed from a set of continuous filament thermoplastic yarns and define a second pile height that is less than the first pile height.

24 Claims, 4 Drawing Sheets

(56) References Cited

U.S. PATENT DOCUMENTS

| | | | | |
|---|---|---|---|---|
| 4,884,597 | A * | 12/1989 | Tamura | D03D 39/22 139/102 |
| 4,896,406 | A | 1/1990 | Weingarten et al. | |
| 4,941,884 | A | 7/1990 | Green | |
| 5,002,095 | A * | 3/1991 | Herrin | D03D 39/223 139/102 |
| 5,014,756 | A * | 5/1991 | Vogel | D03D 39/223 139/102 |
| 5,447,182 | A * | 9/1995 | Gehrig | D03D 39/22 139/25 |
| 5,722,465 | A * | 3/1998 | Herrlein | D03D 39/223 139/25 |
| 6,015,618 | A | 1/2000 | Orima | |
| 6,029,715 | A * | 2/2000 | Matsumoto | D03D 49/04 139/102 |
| 6,112,773 | A * | 9/2000 | Geiger | D03D 39/226 139/26 |
| 6,367,511 | B2 * | 4/2002 | Wahhoud | D03D 39/223 139/25 |
| 6,803,332 | B2 | 10/2004 | Andrews | |
| 8,733,075 | B2 | 5/2014 | Mandawewala | |
| 2001/0039974 | A1 * | 11/2001 | Wahhoud | D03D 39/223 139/25 |
| 2001/0054450 | A1 * | 12/2001 | Wahhoud | D03D 39/226 139/37 |
| 2002/0124365 | A1 * | 9/2002 | Wood | A47L 13/16 26/2 R |
| 2002/0187345 | A1 | 12/2002 | Andrews | |
| 2003/0226610 | A1 * | 12/2003 | Nakada | D03D 39/223 139/11 |
| 2004/0128811 | A1 * | 7/2004 | Mandawewala | D02G 3/406 28/168 |
| 2004/0131821 | A1 | 7/2004 | Mandawewala | |
| 2004/0197557 | A1 | 10/2004 | Eshragi et al. | |
| 2005/0081938 | A1 * | 4/2005 | Krumm | D03D 39/226 139/25 |
| 2006/0037154 | A1 * | 2/2006 | Goineau | D06Q 1/00 8/478 |
| 2006/0277950 | A1 * | 12/2006 | Rock | A41D 13/002 66/169 R |
| 2008/0057261 | A1 * | 3/2008 | Rock | A41D 31/0033 428/85 |
| 2012/0076971 | A1 | 3/2012 | Debnath et al. | |
| 2014/0317865 | A1 * | 10/2014 | Krishna | D06M 16/003 15/209.1 |
| 2015/0173440 | A1 * | 6/2015 | Rock | A41D 31/0038 428/76 |
| 2015/0274483 | A1 * | 10/2015 | Newhouse | B65H 19/28 242/613 |
| 2015/0284881 | A1 | 10/2015 | Yu et al. | |

FOREIGN PATENT DOCUMENTS

| | | | |
|---|---|---|---|
| FR | 2789701 | A1 | 8/2000 |
| JP | S487898 | B1 | 7/1969 |
| JP | 73007898 | B | 3/1973 |
| JP | 51049969 | A | 4/1976 |
| JP | 51119853 | A | 10/1976 |
| JP | 51123342 | A | 10/1976 |
| JP | S5270172 | A | 6/1977 |
| JP | S60119248 | A | 6/1985 |
| JP | S6111347 | B2 | 4/1986 |
| JP | 61138725 | A | 6/1986 |
| JP | 362162030 | A | 7/1987 |
| JP | 63084668 | A | 4/1988 |
| JP | 63125202 | A | 5/1988 |
| JP | H0343034 | A | 2/1991 |
| JP | H04108131 | A | 4/1992 |
| JP | H04257326 | A | 9/1992 |
| JP | H04361660 | A | 12/1992 |
| JP | 06093531 | A | 4/1994 |
| JP | H0693531 | A | 4/1994 |
| JP | 07097745 | A | 4/1995 |
| JP | H0797745 | A | 4/1995 |
| JP | H08109534 | A | 4/1996 |
| JP | H0929078 | A | 2/1997 |
| JP | H0931781 | A | 2/1997 |
| JP | H0959839 | A | 3/1997 |
| JP | 2000-239962 | A | 9/2000 |
| JP | 2000-256929 | A | 9/2000 |
| JP | 2002-285442 | A | 10/2002 |
| JP | 2003-147650 | A | 5/2003 |
| JP | 2005-068596 | A | 3/2005 |
| WO | WO 1997/049326 | A1 | 12/1997 |
| WO | WO 2002/012602 | A1 | 2/2002 |

OTHER PUBLICATIONS

"Dictionary of Fiber & Textile Technology", Hoechst Celanese Corporation, © 1990, 3 pages.

Ito, "Method for Manufacturing Two-Layer Structure Spun Yarn", Jun. 2011, 9 pages.

* cited by examiner

TERRY ARTICLE WITH SYNTHETIC FILAMENT YARNS AND METHOD OF MAKING SAME

TECHNICAL FIELD

The present disclosure relates to articles formed from terry fabrics with filaments yarns and methods of making same.

BACKGROUND

Terry fabrics have a wide range of end uses. More common examples are towels, bath robes, rugs, top of the bed fabrics, bath mats, and seat covers. Terry fabrics include ground warp yarns, weft yarns interwoven with warp yarns, and pile yarns that define piles on one or both sides of the fabric. Terry fabrics are cut to size and hems or selvedges formed along the edges define the shape of the article. Terry fabric design takes into consideration end-use performance requirements and aesthetics. Design features that impact fabric properties and therefore contribute to performance of the fabric during use include fiber type, yarn type, yarn count, pile height, pile density, ground fabric structure, and fabric weight. Optimizing fabric structure for the end-use requirements is difficult and is not always a predictable endeavor.

SUMMARY

There is a need for an article formed from a terry fabric that includes natural and synthetic yarns that also has improved cushion and unique visual features. An embodiment of the present disclosure is a terry article that includes a ground component including a plurality of ground warp yarns and a plurality of weft yarns, and a pile component disposed on at least one of a lower side and an upper side of the ground component. The pile component includes a first plurality of piles that extend away from the ground component along a vertical direction. The first plurality of piles are formed from a first set of pile yarns comprised of natural fibers and further define a first pile height. The pile component also includes a second plurality of piles that extend away from the ground component in the vertical direction. The second plurality of piles are formed from a set of continuous filament thermoplastic yarns and define a second pile height that is less than the first pile height.

Another embodiment of the present disclosure is terry article. The terry article includes a ground component including a plurality of ground warp yarns and a plurality of weft yarns interwoven with the plurality of ground warp yarns. The ground component includes a first side and a second side opposed to the first side along a vertical direction. The terry articles also includes a first pile component disposed on the first side that also includes a plurality of piles, and a second pile component disposed on the second side and that includes a plurality of piles. The plurality of piles the first pile component includes: 1) a first plurality of piles that extend away from the ground component along the vertical direction, the first plurality of piles formed from a first set of pile yarns comprised of natural fibers, the first plurality of piles including a first pile base located at the ground component, a first pile end spaced apart from the first pile base, and a first pile height that extends from the first pile base to the first pile end along the vertical direction; and 2) a second plurality of piles that extend away from the ground component in the vertical direction, the second plurality of piles formed from a set of continuous filament thermoplastic yarns, the second plurality of piles including a second pile base at the ground component, a second pile end spaced apart from the second pile base, and a second pile height that extends from the second pile base to the second pile end along the vertical direction. The second pile height is less than the first pile height.

Another embodiment of the present disclosure is terry article. The terry article includes a ground component including a plurality of ground warp yarns and a plurality of weft yarns interwoven with the plurality of ground warp yarns. The ground component includes a first side and a second side opposed to the first side along a vertical direction. The terry article also includes a first pile component disposed on the first side. The first pile component includes a first plurality of piles that extend away from the ground component along the vertical direction. The first plurality of piles are formed from a first set of pile yarns comprised of natural fibers. The first plurality of piles includes a first pile base located at the ground component, a first pile end spaced apart from the first pile base, and a first pile height that extends from the first pile base to the first pile end along the vertical direction. The terry article includes a second pile component disposed on the second side. The second pile component includes a second plurality of piles that extend away from the ground component in the vertical direction. The second plurality of piles are formed from a set of continuous filament thermoplastic yarns, the second plurality of piles including a second pile base at the ground component, a second pile end spaced apart from the second pile base, and a second pile height that extends from the second pile base to the second pile end along the vertical direction. The second pile height is less than the first pile height.

Another embodiment of the present disclosure is a method of making a terry article. The includes the step of weaving a pile fabric to include a ground component and a pile component disposed on at least one of an upper side and a lower side of the ground component. The weaving step forms the pile component with a first plurality of piles formed from natural fiber yarns and a second set of piles formed from continuous filament thermoplastic yarns. The method includes, after the weaving step, treating the pile fabric so as to cause the continuous filament thermoplastic yarns to shrink, thereby decreasing a pile height of the second plurality of piles relative to a pile height of the first plurality of piles.

BRIEF DESCRIPTION OF THE DRAWINGS

The foregoing summary, as well as the following detailed description of illustrative embodiments of the present application, will be better understood when read in conjunction with the appended drawings. For the purposes of illustrating the present application, there is shown in the drawings illustrative embodiments of the disclosure. It should be understood, however, that the application is not limited to the precise arrangements and instrumentalities shown.

DETAILED DESCRIPTION OF ILLUSTRATIVE EMBODIMENTS

Figure 1:
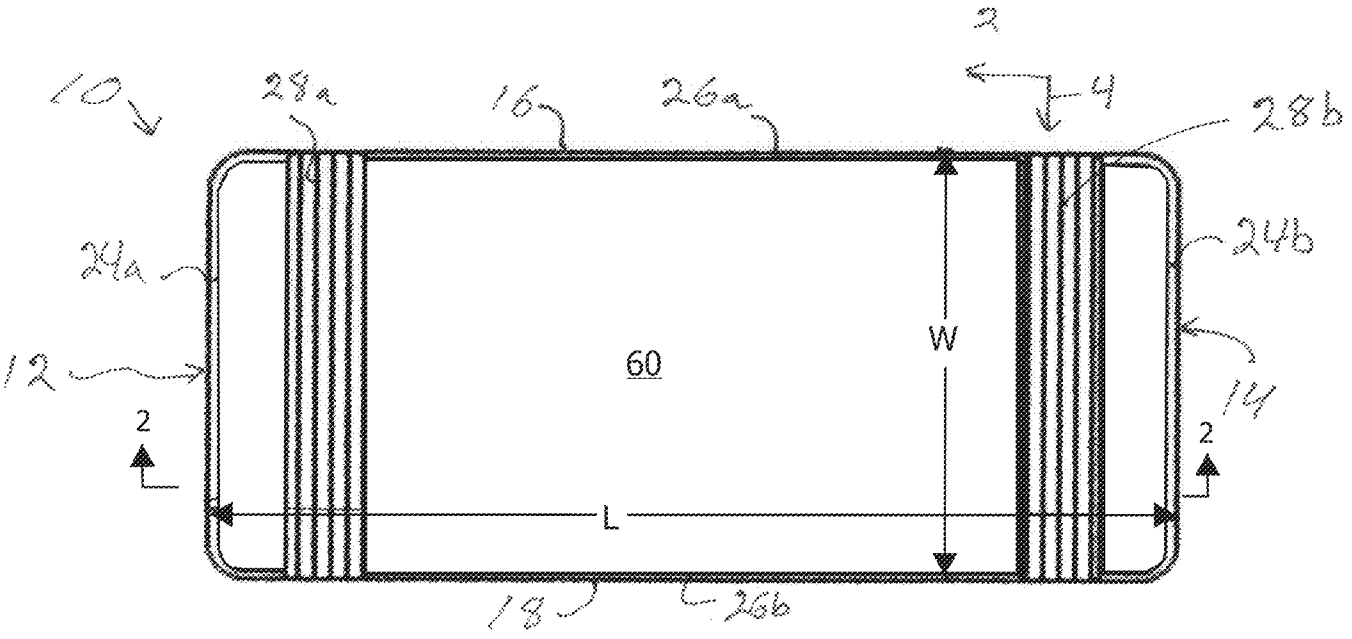
FIG. 1 is a top view of a terry article according to an embodiment of the present disclosure.
Figure 2:
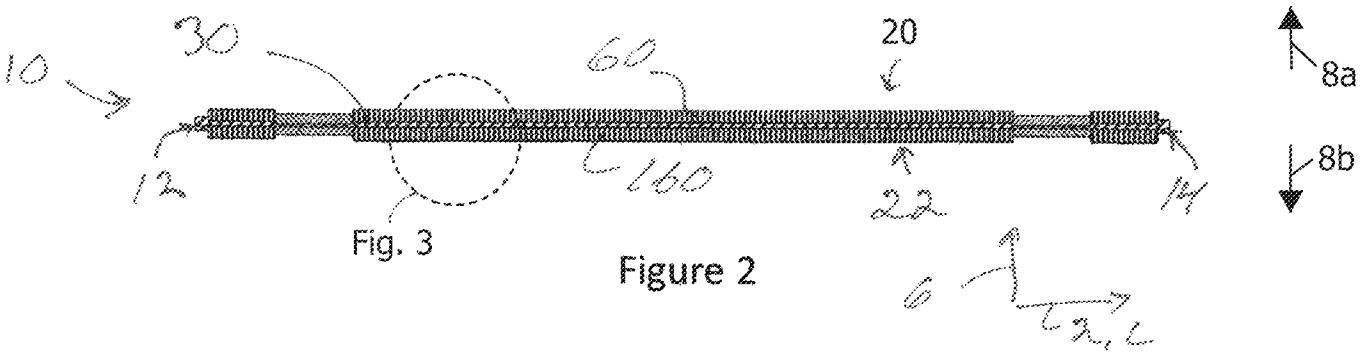
FIG. 2 is schematic cross-sectional view of the terry article taken along line 2-2 in FIG. 1.

As shown in FIGS. 1 and 2, the terry article 10 includes a ground component 30 and at least one pile component. The pile component includes a first set of piles formed from natural yarns and a second set of piles formed from continuous filament thermoplastic yarns. The finishing process creates pile height differential between the first set of piles and the second set of piles. The pile height differential can create a visually observable texture or pattern in the terry article 10. Furthermore, improved cushion profiles are possible by designing the terry article to have different pile heights in different locations on the article 10. Embodiment of the present disclosure include several different pile configurations including first and second piles with a height differential. The different pile configuration include: a) a pile component on only one side of the article that includes the first set of piles and the second set of piles; b) a pile component both sides of article that includes the first set of piles and the second set of piles; and c) a first pile component including the first set of piles disposed on a first side of the article and a second pile component that includes the second set of piles disposed on the other side of the terry article. A "pile" as used herein include a pile loop or a cut pile. As illustrated, the pile fabrics includes pile loops. However, the pile fabrics can include cut piles as well.

The description and figures illustrate a towel article formed from a terry fabric as one example. However, terry articles—products made with or including terry fabrics—can include, but are not limited to, towels, bath robes, rugs, top of the bed fabrics, bath mats, and seat covers. The terry articles as described herein are suitable for home-uses, e.g. for products in bath or kitchen uses, commercial uses, such towels designed for hotels, hospitality business, healthcare and restaurants, and/or industrial uses for cleaning or wiping of spills in industrial settings.

Continuing with FIG. 1, the terry article 10 includes opposed ends 12 and 14 spaced apart along a longitudinal direction 2, and side edges 16 and 18 that extend from the end 12 to end 14 along the longitudinal direction 2. The longitudinal direction 2 can be referred to as the machine direction or warp direction. The side edges 16 and 18 are spaced apart with respect to each other along a lateral direction 4 that is perpendicular to the longitudinal direction 2. The ends 12 and 14 and side edges 16 and 18 collectively define a towel perimeter, which in turn defines a size and shape of the terry article. The article 10 also includes a face 20 and a face 22 opposed to the face 20 along a vertical direction 6 that is perpendicular to the longitudinal and lateral directions 2 and 4, respectively. The terry article 10 has a length L that extends from end 12 to end 14 along the longitudinal direction 2 and a width W that extends along the lateral direction 4. As illustrated, the terry article length L is greater than the width W so as to define shape of a bath towel or hand towel. The dimensions of the terry article 10 can defined during manufacturing to any particular size. For instance, the terry article 10 can be hand towel.

Continuing with FIGS. 1 and 2, the terry article 10 includes ground component 30 and at least one pile component. In illustrated embodiment, the terry article 10 has an upper pile component 60 along a face 20 of the article 10 and a lower pile component 160 along a back 22 of the article 10. In some instances, the terry article 10 includes only one pile component on either the face 20 or back 22. The ground component 30 includes an upper side 32 and a lower side 34 spaced from the upper side along the vertical direction 6. The upper pile component 60 can project away from the upper side 32 of the ground component 30 along the vertical direction 6 in a first direction 8*a*. The lower pile component 160 can project from the lower side 34 along the vertical direction 6 in a second direction 8*b* that is opposite to the first direction 8*a*. The terry article ends 12 and 14 include hems 24*a* and 24*b*, respectively. The side edges 16 and 18 can include hems or selvages 26*a* and 26*b*, respectively. The terry article 10 can also include one or more optional borders 28 that extend across the width W or the length L of the terry article 10. For example, the terry article 10 shown in FIG. 1 includes a first border 28*a* and a second border 28*b*.

As illustrated in FIG. 1, the upper pile component 60 can extend across a majority of the article face 20. Specifically, the upper pile component 60 extends from one border 28*a* to the opposite border 28*b* along the longitudinal direction 2, between border 28*a* and end 12, and also between border 28*b* and end 14. The upper pile component also extends from one hem 26*a* at side edge 16 to the opposing hem 26*b* at side edge 18 along the lateral direction 4. The upper pile component 60 therefore defines substantial portion of the face 20 of the terry article 10. Accordingly, the upper pile component 60 includes a plurality of piles (up to all of the piles) located on the upper side 32 of the ground component 30. In addition, the lower pile component 160 may extend along one or both of longitudinal and lateral direction s 2 and 4 on the lower side 34 of the ground component 30. As shown, the lower pile component 160 corresponds to the upper pile component 60 such that lower pile component 160 defines a substantial portion of the back 22 of the terry article 10. Accordingly, the lower pile component 160 includes a plurality of piles, up to all of the piles, on the lower side 34 of the ground component 34. The upper pile component 60 may be referred to as a first pile component and the lower pile component 160 may be referred to as a second pile component.

The ground component 30 includes a plurality of ground warp yarns 40 and a plurality of weft yarns 42 interwoven with the plurality of ground warp yarns 40. The ground component 30 may defined by a number of woven structures. Exemplary woven structures for the ground component 30 include, but are not limited to, 1×1 plain weave, 2×1 rib weave, 2×2 rib weave, or 3×1 rib weave. As further explained below, the ground warp and weft yarns each comprise one or more of natural fiber and a synthetic fiber. For instance, each ground warp yarns may be natural fiber yarns, synthetic fiber yarns, or a blended natural and synthetic fiber yarns.

The ground warp yarns 40 can be formed from any number of fiber types. For instance, the ground warp yarns can be natural fiber yarns, synthetic yarns, natural and synthetic blended yarns. Synthetic yarns with good moisture absorbency and/or retention properties may be used in some instances as the ground warp yarns. The natural fiber yarns may include primarily cotton fibers, flax, bamboo, hemp, or other natural fibers. Natural and synthetic blended yarns can include blends of cotton and polyethylene terephthalate (PET) staple fibers, cotton and polylactic acid (PLA) staple fibers, and cotton and polypropylene (PP) staple fibers. The present disclosure is not limited to cotton blends. Other natural and synthetic blends include cotton and staple microfibers. Additional natural and synthetic blends include cotton and staple fibers with complex cross-sectional shapes. In another example, the natural and synthetic blended yarns can include cotton fibers in a core-spun construction with a synthetic filament comprising the core. Synthetic yarns may include rayon fibers (e.g. Modal, Lyocell), microfiber staple fibers, or blends of PET and polyamide microfibers.

The ground warp yarns 40 can be any type of spun yarn structure. For example the ground warp yarns can be ring spun yarns, open end yarns, or rotor spun yarns, or filaments In another embodiment, the ground warp yarns can be Hygrocotton® brand yarns marketed by Welspun India Limited. Furthermore, yarns can be formed as disclosed in U.S. Pat. No. 8,833,075, entitled "Hygro Materials for Use In Making Yarns And Fabrics," (the 075 patent). The 075 patent is incorporated by reference into present disclosure. The ground warp yarns have a count in a range between about 6 Ne to about 60 Ne. In one example, the ground warp yarns have a count of about 16 Ne. In another example, the ground warp yarns have a count of about 20 Ne. In another example, the ground warp yarns have a count of about 24 Ne. In another example, the ground warp yarns have a count of about 30 Ne. In another example, the ground warp yarns have a count of about 34 Ne. In another example, the ground warp yarns have a count of about 40 Ne. In another example, the ground warp yarns have a count of about 50 Ne. In addition, the ground warp yarns can be plied yarns. In one example, the natural fiber warp yarn is 2-ply yarn. In another example, the ground warp yarns yarn is a 3 ply yarn.

The weft yarns 42 can be formed from a number of fiber types in a variety of different yarn structures. For instance, the weft yarns can be natural fiber yarns, synthetic yarns, natural and synthetic blended yarns. The ground weft yarns can be ring spun yarns, open end yarns, or rotor spun yarns, or filaments. The ground weft yarns can be Hygrocotton® brand yarns marketed by Welspun India Limited. Furthermore, yarns can be formed as disclosed the 075 patent. The weft yarns 42 can have a count in a range between about 6 Ne to about 60 Ne. In accordance with the illustrated embodiment, the weft yarns 42 can be similar to the ground warp yarns described above.

Figure 3:
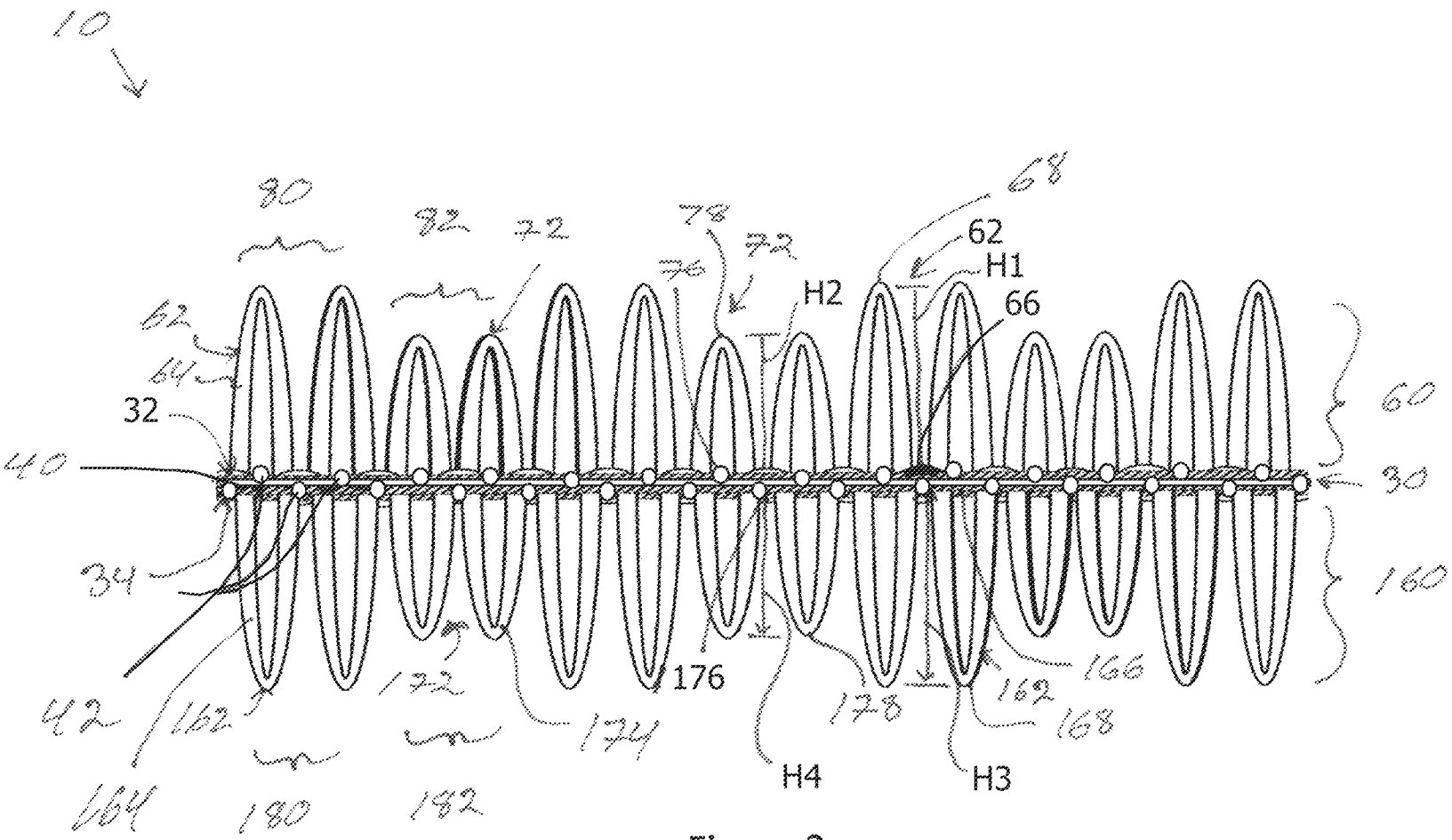
FIG. 3 is a detailed sectional view of a portion of the terry article shown in FIG. 2.

Turning to FIG. 3, the upper pile component 60 can be disposed on the upper side 32 of ground component 30. In accordance with the illustrated embodiment, the upper pile component 60 includes an upper first plurality of piles 62 that extend away from the ground component 30 in the first direction 8*a*. The first plurality of piles 62 are formed by a first set of pile yarns 64. The first plurality of piles 62 further define a base 66 located at the ground component 30, a pile end 68 spaced apart from the base 66 along a respective pile loop 62, and a first pile height H1 that extends from the base 66 to the pile end 68. The first pile height H1 may be referred to as the upper first pile height H1.

The upper pile component 60 includes a second plurality of piles 72 that extend away from the ground component 30 in the first direction 8*a*. The second plurality of piles 72 are formed from a set of continuous filament thermoplastic yarns 74. The continuous filament thermoplastic yarns may be referred to as second pile yarns. Each loop 72 includes a pile base 76 at the ground component 30, a pile end 78 spaced apart from the pile base 76, and a second pile height H2 that extends from the pile base 76 to the pile end 78. The second pile height H2 may be referred to as the upper second pile height H2. The upper pile component 60 is configured such that the upper second pile height H2 is less than the upper first pile height H1 due to thermally induced shrinkage of the continuous filament thermoplastic yarns 74. In one example, the upper second pile height H2 is at about 1 mm to about 5 mm less than the upper first pile height H1. In one example, the upper second pile height H2 is at least 15% less than the upper first pile height H1. In another example, the upper second pile height H2 is between about 15% to about 50% less than the upper first pile height H1. In another example, the upper second pile height H2 is between about 20% to about 40% less than the upper first pile height H1. In another example, the upper second pile height H2 is between is about 20% less than the upper first pile height H1. In yet another example, the upper second pile height H2 is between is about 30% less than the upper first pile height H1. In yet another example, the upper second pile height H2 is about 40% less than the upper first pile height H1.

Figure 5:
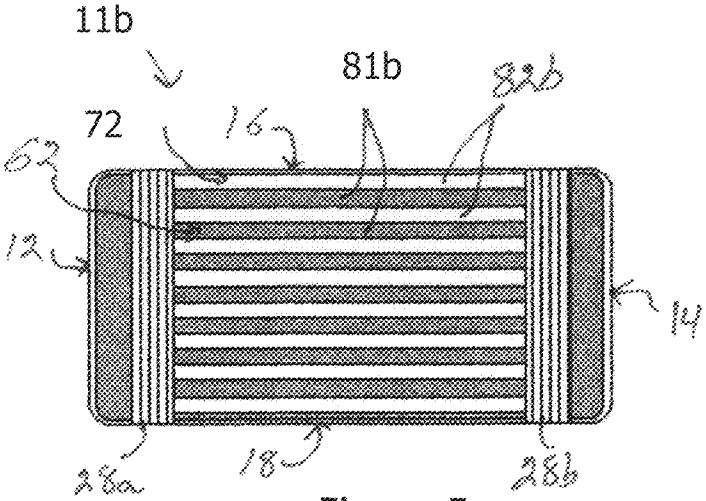
FIG. 5 is a top view of a terry article according to another embodiment of the present disclosure.
Figure 4:
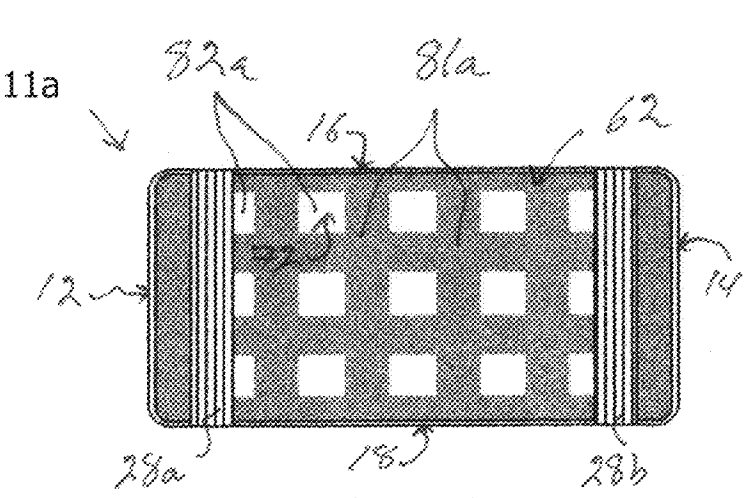
FIG. 4 is a top view of a terry article according to another embodiment of the present disclosure.
Figure 7:
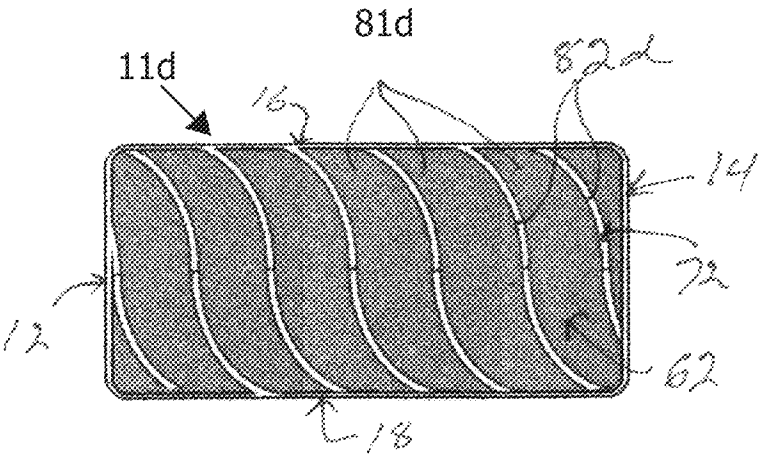
FIG. 7 is a top view of a terry article according to another embodiment of the present disclosure.
Figure 6:
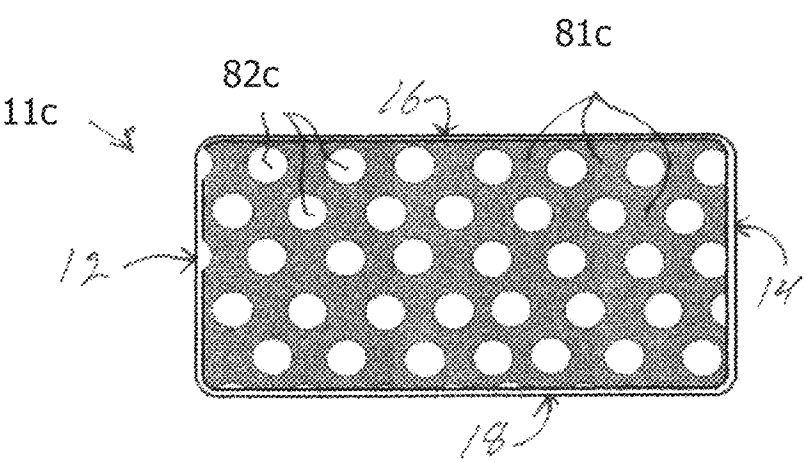
FIG. 6 is a top view of a terry article according to another embodiment of the present disclosure.

The upper pile component 60 includes first pile zones 80 that include the first piles 62 and second pile zones 82 that include the second piles 72. The first and second pile zones 80 and 82 can be randomly distributed across the terry article 10 such that the height differential between the first and second pile loops 62 and 72 creates visually perceptible texture across width W and length L of the upper pile component 60. Turning to FIGS. 4-7, in accordance with the illustrated alternative embodiments, the first and second pile zones 80 and 82 can define distinct shapes with respect to each other. Specifically, the first and second pile zones 80 and 82 can be configured to have one or more of a linear, curvilinear, and rectilinear shape. FIG. 4 illustrates an alternative embodiment of a terry article 11*a* that includes a first pile zone 81*a* that surrounds multiple square shaped second zones 82*a*. In FIG. 5, an alternative embodiment of a terry article 11*b* includes rectilinear shaped first pile zones 81*b* and rectilinear shaped second zones 82*b*. In FIG. 6, in accordance with another alternative embodiment, a terry article 11*c* includes a first pile zone 81*b* that surrounds circular shaped second zones 82*b*. In FIG. 7, an alternative embodiment of a terry article 11*d* includes a plurality of curvilinear shaped bands that define the first pile zones 81*d* and curvilinear narrow bands that define second zones 82*d*.

As described above, the first pile yarns 64 define the first plurality of piles. The first pile yarns 64 may include natural fibers. The natural fibers in the first pile yarns 64 can be cotton, flax, bamboo, hemp, or other natural fibers with improved moisture absorbency and retention properties. In one example, the natural fibers are cotton fibers. Furthermore, the first pile yarn can be a ring spun yarn, an open end yarn, a rotor spun yarn, or the Hygrocotton® brand yarn in accordance with the 075 patent. The first pile yarns 64 may have a count between about 6 Ne to about 60 Ne. In one example, the first pile yarns 64 may have a count between 10 Ne to about 50 Ne, and preferably between about 10 Ne to about 30 Ne. In another example, the first pile yarns 64 may have a count between 10 Ne to about 24 Ne. In one example, the first pile yarns 64 have a count of about 16 Ne. In another example, the first pile yarns 64 have a count of about 20 Ne. In another example, the first pile yarns 64 have a count of about 24 Ne. Furthermore, the first pile yarns 64 can have between about 150 and 350 turns/meter of twist, preferably between about 200 to about 300 turns/meter of twist. In addition, the first pile yarns 64 can be plied yarns. In one example the first pile yarn is 2-ply yarn. In another example, the first pile yarns 64 are 3-ply yarns. In another example, the first pile yarns 64 are 4-ply yarns.

The second pile yarns 74 include continuous filament thermoplastic yarns and define the second piles. The continuous filament yarns may include PET filaments, PLA filaments, PP filaments, or other filaments formed from thermoplastic polymers. The continuous filament thermoplastic yarns are configured to shrink along the yarn length and possibly radially in presence of a treatment. Yarn shrinkage, in turn, causes the second pile height H2 (the second piles) to decrease relative to the pile height H1 of the first piles. Accordingly, the treatment causes the pile height in the second plurality of piles to decreases.

In one example, the second pile yarns 74 include continuous filament thermoplastic yarns that are considered "non-heatset yarns." Non-heat set yarns are processed in such a way that fiber morphology and stresses have not been fixed as result of heat set processing. For instance, the non-heat set yarns have not subjected to heatset process during yarn formation, as is known in the art. As a result, subsequent exposure of non heat yarns (the second pile yarns 74) once formed into the pile fabric to a temperature that exceeds the glass transition temperature (Tg) of the polymer forming the filaments, for a sufficient period of time, causes the non-heat set yarns to shrink along the yarn length and possibly radially. This in turn causes the second pile height H2 (the second piles) to decrease relative to the pile height H1 of the first piles. A treatment can be thermal treatments, such as hot air or hot water as described below. However, it should be appreciated that non-heat set yarns could be partially heatset. For instance, a partially non-seat filaments can processed so as to induce some level of ordering of the fiber morphology and fixation of internal stresses, but not the extent that the fully heat-set yarn processes would. A partially non-heat set yarn exposed to a temperature that exceeds the glass transition temperature (Tg) of the polymer forming the filaments, for a sufficient period of time, would also cause the partially non-heat set yarns to shrink along the yarn length and possibly radially. The phrase "non-heat set yarn" includes a non-heatset yarn and a partially non-heatset yarn, unless specifically noted otherwise or claimed separately.

The treatment used to induce yarn shrinkage can vary based on type of continuous filament thermoplastic yarns used to form the second piles. For instance, the second pile yarns 74 can include continuous filament thermoplastic yarns that may be heatset yet capable of shrinkage in the presence of treatment, such as elevated temperatures as described above.

In accordance with the illustrated embodiment, the continuous filament thermoplastic yarns have a count between about 75 denier to about 1230 denier. In another example, the continuous filament thermoplastic yarns have a count between about 75 denier to about 900. In another example, the continuous filament thermoplastic yarns have a count between about 170 denier to about 530. In another example, the continuous filament thermoplastic yarns have a count between about 200 denier to about 400 denier. In another example, the continuous filament thermoplastic yarns have a count between about 220 denier to about 330 denier. In another example, the continuous filament yarns have a count of about 220 denier. In another example, the continuous filament yarn has a count of about 270 denier. In another example, the continuous filament yarn has a count of about 330 denier.

Continuing with FIG. 3, the terry article 10 can also include the lower pile component 160. The lower pile component 160 is sometimes referred to as the second pile component. In accordance with the illustrated embodiment, the lower pile component 160 includes a lower first plurality of piles 162 that extends away from the ground component 30 in the second direction 8*b*. The lower first plurality of piles 162 are formed by a first set of pile yarns 164, which are similar to the first pile yarns 64 that form piles 62 in the upper pile component 60. The first plurality of piles 162 further define a base 166 located at the ground component 30, a pile end 168 spaced apart from the base 166 along a respective pile loop 162, and a third pile height H3 that extends from the base 166 to the pile end 168. The third pile height H3 may be referred to as lower first pile height H3. The lower pile component 160 also includes a lower second plurality of piles 172 that project away from the ground component 30 in the second direction 8*b*. The second plurality of piles 172 are formed from a set of continuous filament thermoplastic yarns 174 which are similar the continuous filament yarns 74 that form loops 72 in the upper pile component 60. The second plurality of piles 172 include a pile base 176 at the ground component 30, a pile end 178 spaced apart from the pile base 176, and a fourth pile height H4 that extends from the pile base 176 to the pile end 178. The fourth pile height referred to as the lower second pile height H4. The lower pile component 160 is configured such that the fourth pile height H4 is less than the third pile height H4 as a result of thermally induced shrinkage of the continuous filament thermoplastic yarns 174. In one example, the lower second pile height H4 is at least 15% less than the lower first pile height H3. In another example, the lower second pile height H4 is between about 15% to about 50% less than the lower first pile height H3. In another example, the lower second pile height H4 is between about 20% to about 40% less than the lower first pile height H3. In another example, the lower second pile height H4 is between is about 20% less than the lower first pile height H3. In yet another example, the lower second pile height H4 is between is about 30% less than the lower first pile height H3. In yet another example, the lower second pile height H4 is about 40% less than the lower first pile height H3.

The lower pile component 160 can also include or more first pile zones 180 that include the lower first piles 162, and one or more second pile zones 182 that include the lower second piles 172. The first and second pile zones 180 and 182 can be randomly distributed across the terry article 10 such that the height differential between the lower first and second piles 162 and 172 creates a visually perceptible texture across width W and length L of the lower pile component 160. In other embodiments, the first and second pile zones 180 and 182 can define distinct shapes with respect to each other. For example, the pile zones 180 and 182 can define one or more of linear, curvilinear, and rectilinear shapes.

Figure 8:
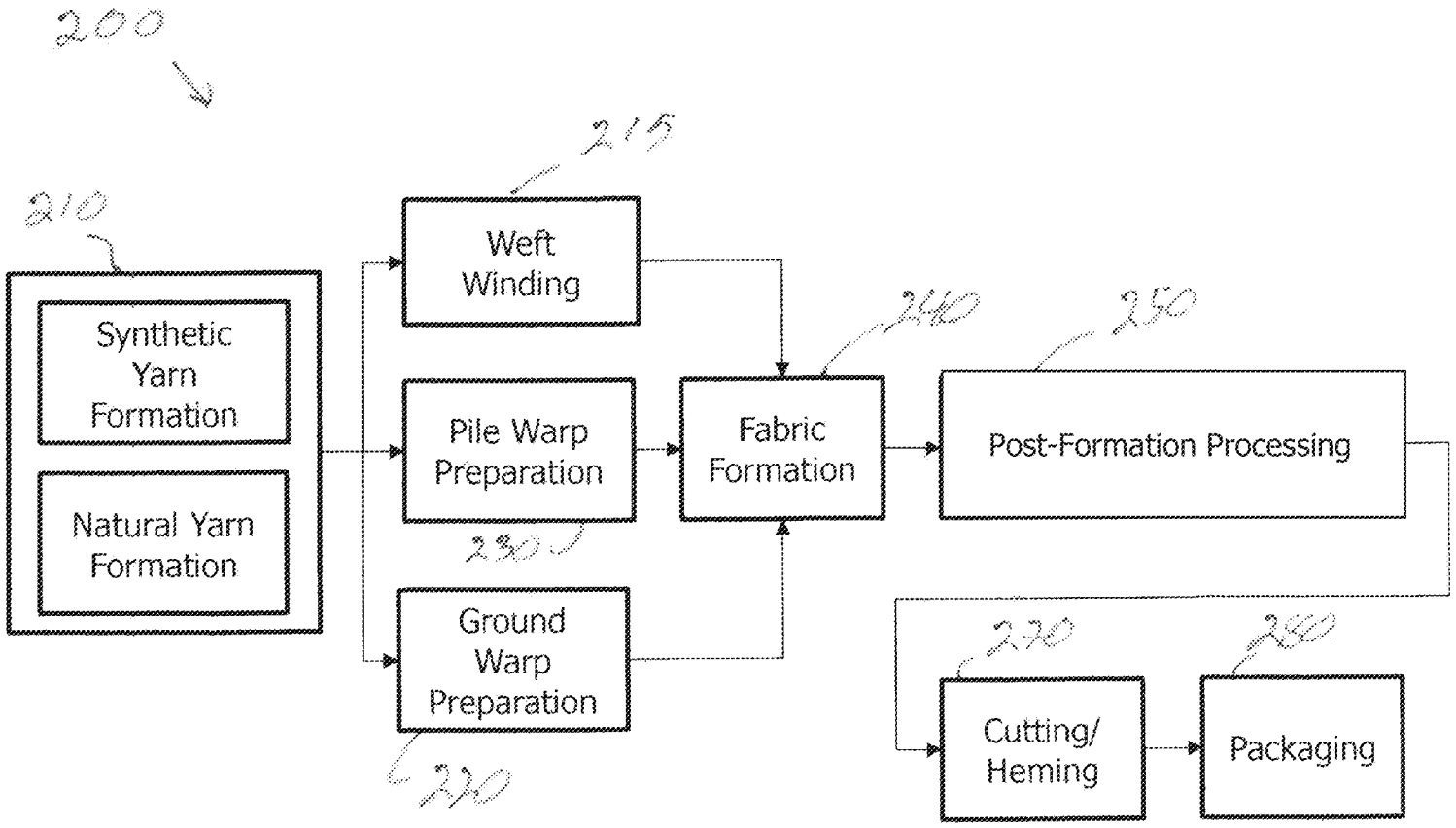
FIG. 8 is a process flow diagram illustrating process steps in the manufacture the terry article illustrated in FIGS. 1-7.

A method of making a terry article according to an embodiment of the disclosure is illustrated in FIG. 8. The method 200 includes yarn formation processing steps 210 for: a) ground warp yarns, b) weft yarns, c) the first pile warp yarns, and d) the second pile warp yarns. In embodiments where the terry article 10 includes upper and lower pile components 60 and 160, yarn formation 210 can includes forming additional first and second pile yarn sets for the lower pile component 160. Exemplary yarn formation phases will be described next.

During yarn formation 210, the ground warp yarns may be formed from any number of fiber types. The ground warp yarns can be formed primarily with natural fibers, natural and synthetic blended fibers, and synthetic fibers or yarns with good moisture absorbency and/or retention properties, as described above. In one example, the ground warp yarns are formed primarily from natural fibers, such as cotton.

Yarn formation 210 for the ground warp yarns can include various staple yarn spinning systems. Such yarn spinning systems may include bale opening, carding, optionally combing, drafting, roving, and yarn spinning (yarn spinning processes are not illustrated) to the desired count and twist level. In some cases, the ground warp yarns can be plied into 2-ply, 3-ply, or 4-ply configurations. After yarn spinning, the ground warp yarns are wound into the desired yarn packages for ground warp preparation step 220. In one example, ring spinning is the preferred spinning system. However, the ground warp yarns can be formed using open end spinning systems or rotor spun spinning systems. Furthermore, the spinning system may include methods to form the Hygrocotton®, as disclosed in the 075 patent. The 075 patent is incorporated by reference into present disclosure.

During yarn formation 210, the weft yarns may be formed with similar fiber types and using the same or similar yarn spinning systems used to form the ground warp yarns. As needed, the weft yarns may be plied in 2-ply, 3 ply, or 4-ply configurations. Following weft yarn spinning, the weft yarns are wound onto desired packages. The wound packages are then staged for weft insertion during fabric formation steps discussed further below.

Yarn formation step 210 includes forming the upper first pile yarns 64 from natural fibers using typical yarn spinning systems. For instance, the first pile yarns 64 may formed using the same or similar process to how the warp yarns were formed. In one example, the natural fibers are cotton fibers. The first pile yarn formation steps produces pile yarns with a desired count and twist level as described above. However, it should be appreciated that the first pile yarn count and twist level can vary as needed based on the specific end use. First pile yarn formation steps may include plying the yarns into 2-ply, 3-ply, or 4-ply configurations. In addition, the first pile yarns 64 can be formed from blends of cotton and synthetic fibers, such as PET fibers. In alternative embodiments, the first pile yarns 64 are formed using other fibers, such as viscose rayon.

The second pile yarns 74 are formed via continuous filament yarn formation systems. In continuous filament yarn formation, polymer resins (such as PET, PLA, and PP) are melted and extruded through orifices at temperatures that approach the polymer melting temperature (Tm). From the orifices, the filaments may be slightly tensioned by passing over one or more godets before being wound onto a desired yarn packages. Additional bulking or texturizing steps may be included to increase the bulk and impart "false twist" to the yarns. Preferably, the continuous filament yarns 74 are not subjected to extensive heat drawing and tension during yarn formation so that the resulting filaments are not heatset (or heat set via subsequent steps prior to fabric formation). Accordingly, the second pile yarns 74 are sometimes may be non-heatset yarns. As noted above, non-heatset yarns can shrink if exposed to temperatures at or above the respective polymer glass transition temperature (Tg), in absence of tension applied to the yarns. As further described below, utilization of non-heatset yarns 74 to form the second piles and the subsequent exposure to sufficient thermal energy causes the second piles 72 to shrink and reduce the pile height H2, as further detailed below. Continuous filament formation steps result in continuous filament yarns 74 with the desired counts as described above.

In a method of forming terry article 10 with upper and lower pile components 60 and 160, the yarn formation step 210 may include forming lower first and second lower pile yarns, in addition to the steps of forming upper first and second pile yarns 64 and 74. Forming lower first and second pile yarns is similar to the production steps in forming the first pile yarns 64 and the second pile yarns 74.

Following the yarn formation 210, the method proceeds to a ground warp preparation step 220 and a pile warp preparation step 230. The ground warp preparation step 220 includes one or more ground warping steps, whereby the ground yarn ends are removed from their respective yarn packages, arranged in a parallel form, and wound onto a ground warp beam. The ground warp preparation step 220 also includes a sizing step where a typical sizing agent is applied to each ground warp yarn to aid in fabric formation. The ground warp preparation step 220 results in a warp beam of ground warp yarns prepared for weaving. The ground warp beam can be positioned on a mounting arm of a weaving loom so that the ground warp yarns can be drawn through the loom components, as further described below.

The pile warp preparation step 230 includes similar steps to the ground warp preparation steps—warping and sizing. In particular, pile warp preparation 230 includes warping and sizing the first pile yarns 64 (e.g. the natural fiber pile yarns). Furthermore, the pile warp preparation step 230 also includes warping and sizing a second pile warp of the continuous filament thermoplastic yarns 74 (i.e. the non-heatset yarns). Thus, the pile warp preparation step 230 results in at least two different pile warp beams: a first pile warp beam and a second pile warp beam.

For embodiments of terry articles that include upper and lower pile components 60 and 160, the pile warp preparation 230 step includes preparing four separate pile warp beams: two upper pile warp beams and two lower pile warp beams. More specifically, the pile warp preparation step 230 can include preparing warp of first pile yarns 64, e.g. natural fiber yarns. The pile preparation step 230 also includes preparing a warp of continuous filament thermoplastic yarns 74. The pile preparation step 230 also included preparing a lower first pile warp of yarns. In one example, the lower first pile yarns are natural fiber yarns that are similar to the yarns in the upper first pile warp. The pile preparation step also includes preparing a lower second warp of continuous filament thermoplastic yarns. Step 230 results in four pile warp beams, with two upper pile warp beams dedicated to forming the first and second upper loops in the upper pile component 60, and two lower pile warp beams dedicated to forming the first and second lower piles in the lower pile component 160. The ground and pile warp beams are positioned on respective mounting arms or mounting brackets proximate the weaving loom (not shown).

Continuing with FIG. 8, following the ground warp and pile warp preparation steps 220 and 230, a weaving step 240 forms a pile fabric by forming the ground component 30 and the pile component on one side (or both sides) of the ground component 30 using a weaving loom designed for terry weaving. More specifically, in the weaving step 240, each ground warp yarn and pile warp yarn from the respective warp beams are drawn-in (not shown) through various components of a weaving loom, such as drop wires, heddle eyes attached to a respective harness, reed and reed dents, in a designated order as is known in the art.

After drawing-in is complete, the weaving step 240 proceeds through two phases: a ground component formation phase and a pile component formation phase. Both phases include a particular shedding motion to facilitate interweaving the weft yarns with the ground warp yarns and pile warp yarns to create the desired pile fabric construction. For instance, shedding motions can include cam shedding, dobby shedding, or jacquard shedding motions, each of which can cause the selective raising and lowering of warp ends to create an open shed for weft insertion. In one example, the weaving loom may be configured for one type of shedding motion for the ground warp yarns and another type of shedding motion for the pile warp yarns. For instance, a cam or dobby shedding motion can be used for the ground warp yarns and the jacquard shedding motions can be used for the pile warp yarns. A specific reed motion and warp take-off system is utilized to form the piles during the pile component phase and such a mechanism using a terry weaving loom is well known and will not be repeated here.

During the ground component phase of the weaving step 240, weft yarns are interwoven with the ground warp yarns to define the ground component or ground fabric. Exemplary ground fabric woven constructions include: a 1×1 plain weave, 2×1 rib weave, 2×2 rib weave, or 3×1 rib weave. Other woven constructions in the ground fabric are possible as well. The ground component formation phase can utilize different weft insertion techniques, including air-jet, rapier, or projectile type weft (fill) insertion techniques.

The pile component phase of the weaving step 240 includes interweaving the first pile yarns 64 (via the first warp) with the ground warp and weft yarns to create a first set of piles that extend away from the ground component along a vertical direction V. In addition, the weaving step includes interweaving the continuous filament yarns with the ground warp and weft yarns to form the second set of piles that extend along the vertical direction V. If plied yarns are used to create the piles, the piles will have a spiral shape. Otherwise, the pile have what is referred to as upright shape.

The weaving step 240 can further include weaving one or more borders across a length L, width W, or along other directions that angularly offset with respect to length L and width W of the pile fabric. Forming such a border includes weaving the border with a weft or pick density that is 3 or more times greater than the pick density of adjacent portions of the pile fabric. The weaving step 240 can further include weaving one or more selvedge edges along a length L of the pile fabric.

The weaving step 240 can form pile fabrics having any number of different fabric constructions. In one example, the pile fabric is formed to result in a 3-pick up to 7-pick (or more) terry weave pattern. Furthermore, the pile fabric can have a 1:1 warp order where each ground warp end is followed by a pile warp end across the width of the pile fabric. In other embodiments, the pile fabric can have a 2:2 warp order a pair of ground warp ends are followed by a pair of pile warp end across the width of the pile fabric. In one example, the pile fabric can be formed to include between about 15 to about 45 ends/cm, preferably between about 20 and 30 ends/cm. The weft or pick density can range between about 10 picks/cm to about 30 picks/cm. Preferably, the pick density is between about 15 picks/cm to about 25 picks/cm.

In embodiments with upper and lower pile components 60 and 160, the weaving step 240 further includes forming upper pile component 60 on the upper side 32 of the ground component 30 and forming the lower pile component 160 on the lower side 24 of the ground component 30. As noted above, the lower pile component 160 includes a lower first set of piles 162 formed from natural fiber yarns and a lower second set piles are formed with continuous filament thermoplastic yarns.

Following weaving step 240, the pile fabric is subjected to a post-formation processing step 250. The post-formation processing or treatment step 250 can cause the continuous filaments yarns (or second piles) to shrink, which decreases a pile height of the second plurality of piles relative to the pile height of the first plurality of piles. In one example, the treatment step can include a thermal treatment in one or more of a dyeing and finishing phase, a drying phase, or in a separate process phase. The thermal treatment is described next and its application to the dyeing and finishing phase, the drying phase, and as separate process phase is described afterwards.

In accordance one embodiment, the treatment step includes exposing the pile fabric to thermal energy for a period of time that is sufficient to cause the continuous filament thermoplastic yarns to shrink. Such treatment step may include exposing the pile fabric to heated air, a heated surface (e.g. a calendar roll), heated water (e.g. heated liquid bath or heated steam), or an infrared heat source. In such an embodiment, the treatment step includes advancing the pile fabric through a machine that exposes the pile fabric to thermal energy for a period of time that is sufficient to induce shrinkage in the non-heat set yarns. The thermal energy is sufficient to expose the pile fabric to a temperature that is greater than or equal to the glass transition temperature (Tg) of the continuous filament thermoplastic yarn. For instance, the surface temperature of the pile fabric during the thermal treatment step 260 may approach or exceed the glass transition temperature (Tg) of the continuous filament thermoplastic yarns. For non-heatset PET filament yarns, the glass transition temperature (Tg) is between about 67 to 81 degrees Celsius. For non-heatset PLA filaments, the glass transition temperature (Tg) is between about 60 to 65 degrees Celsius. For non-heatset PP filaments, the pile fabrics are exposed to temperature between about 100 and to 130 degrees Celsius. Accordingly, the desired surface temperature of the pile fabric should fall within or exceed somewhat the stated ranges for each of the fibers mention above.

The dyeing and finishing phases include may include de-sizing step, a bleaching step, a dyeing step, and/or washing step. In one example, the bleaching phase may include the thermal treatment that is sufficient to cause shrinkage of continuous filament yarns in the second set of piles as described above. For instance, washing may include exposing the fabrics to elevated temperatures that are needed to bleach the fabric but could also induce shrinkage in the continuous filament yarns. In another example, the dyeing phase may include a thermal treatment that is sufficient to cause shrinkage of continuous filament yarns in the second set of piles, as described above. For instance, the dying phase may include applying reactive dyes to natural fiber yarns, and cotton yarns in particular, at elevated temperatures sufficient to cause yarn shrinkage. Either batch, semi-continuous, or continuous dyeing system can be used to apply reactive dyes the pile fabric. Other dyes can be used depending on the particular fiber blend. In still another example, for example for package dyed yarns, the washing step can include a thermal treatment that is sufficient to cause shrinkage of continuous filament yarns in the second set of piles. The dyeing and finishing phase could also include printing as needed.

The finishing phase of step 250 is when various functional finishes or agents are added to the pile fabric to improve or augment performance characteristics of the terry article. In one example, the pile fabric can be treated with a hydrophilic agent, such as silicones. In another example, the finishing step includes application of one or more softeners to the fabric, such as cationic softeners, non-ionic softeners, and silicones. In another example, the finishing step includes application of an antimicrobial agent to the pile fabric. In accordance with one embodiment, the finishing step could also include the thermal treatment that causes shrinkage of continuous filament yarns in the second set of piles.

In accordance with one embodiment, after dyeing and finishing phases of step 250, the drying step is used to remove moisture from the pile fabric. The drying step also includes a thermal treatment step that can cause shrinkage of the continuous filament yarns that may cause the second set of piles to shrink. For example, when the pile fabrics include non-heat set yarns in pile components 60 and 160, a treatment step that dries the fabric may also cause the continuous filament thermoplastic yarns to shrink, as explained above.

It should be appreciated that in some case, dyes and functional finishes can be applied to the fabric in any particular order. For example, the functional agents can be applied along with the application of the dyes, before application of the dyes, or after application on the dyes. It should be appreciated that dyeing, finishing, and drying phases of step 250 may be in-line and considering a continuous process step.

In accordance with another embodiment, the pile fabric can be dried and then a subsequent process phase is used where the thermal treatment step is applied the pile fabric to cause the continuous filament thermoplastic yarns to shrink. For example the pile fabric can be exposed to the desired thermal energy levels for a period of time that is sufficient to induce shrinkage. The exposure time is dependent on the dwell time of pile fabric within a heating machine, which is related to the machine speed and length of the heating zones within the heating machine. In one example, the pile fabric is advanced through the heating machine at a rate that ranges between 2.0 meters/min up to about 30 meters/min, which varies based on number heating zones. In case of batch processing, the pile fabric may be process for periods sufficient to induce shrinkage.

As noted above, the it should be appreciated that the thermal treatment step can be part of one or more of the different steps that comprise the dyeing and finishing phase, the drying phase, or in a separate thermal step. Accordingly, the thermal treatments include hot water (as part of dyeing finishing phases discussed above), convection, heated steam, infrared, hot air, surface rolls, hot oil can, through-air ovens and the like. Regardless of when the treatment step is performed, shrinkage of the continuous filament thermoplastic yarns decreases a pile height of the second plurality of piles relative to the pile height of the first plurality of piles In accordance with the alternative embodiments, the treatment step can be a process step other than thermal treatment. For instance, a chemical treatments may be used induce yarn shrinkage. In other embodiments, plasma treatments or other types of treatment can be used to induce yarn shrinkage.

Following the post-formation processing step 250, the method includes a cutting step 270 where the pile fabric is cut to size of one or more terry articles, such as bath towel, a hand towel, and a washcloth. Following cutting 270, additional edge binding or hems can be applied to finish the cut edges. After the cutting step, a packing step 280 places the finished terry articles in suitable packaging for shipment.

While the disclosure is described herein using a limited number of embodiments, these specific embodiments are not intended to limit the scope of the disclosure as otherwise described and claimed herein. The precise arrangement of various elements and order of articles and methods described herein are not to be considered limiting. For instance, although the steps of the methods are described with reference to sequential series of reference signs and progression of the blocks in the figures, the method can be implemented in any particular order, as desired.

What is claimed:

1. A terry article comprising:

a ground component including a plurality of ground warp yarns and a plurality of weft yarns interwoven with the plurality of ground warp yarns, the ground component including a lower side and an upper side opposed to the lower side along a vertical direction; and a pile component including 1) a first plurality of piles that extend away from the ground component along the vertical direction, the first plurality of piles formed from a first set of pile yarns comprised of natural fibers, the first plurality of piles including a first pile base located at the ground component, a first pile end spaced apart from the first pile base, and a first pile height that extends from the first pile base to the first pile end along the vertical direction, and 2) a second plurality of piles that extend away from the ground component in the vertical direction, the second plurality of piles formed from a set of continuous filament thermoplastic yarns, the second plurality of piles including a second pile base at the ground component, a second pile end spaced apart from the second pile base, and a second pile height that extends from the second pile base to the second pile end along the vertical direction, wherein the second pile height is less than the first pile height.

2. The terry article of claim 1, wherein the pile component is an upper pile component that is disposed on the upper side, wherein the first plurality of piles is an upper first plurality of piles, and the second plurality of piles is a upper second plurality of piles.

3. The terry article of claim 2, further comprising a lower pile component disposed on the lower side, the lower pile component including a lower first plurality of piles and a lower second plurality of piles, wherein the lower second plurality of piles are formed from continuous filament thermoplastic yarns.

4. The terry article of claim 1, wherein the first plurality of piles are randomly distributed among the second plurality of piles across a length and width dimension of the pile component.

5. The terry article of claim 1, further comprising a plurality of first pile zones that include the first plurality of piles, and a second plurality of pile zones that include the second plurality of piles, wherein the first and second pile zones are visually distinct with respect to each other.

6. The terry article of claim 5, wherein the first pile zones defines one or more of a linear shape, a curvilinear shape, and a rectilinear shape.

7. The terry article of claim 5, wherein the second pile zones defines one or more of a linear shape, a curvilinear shape, and a rectilinear shape.

8. The terry article of claim 1, wherein the continuous filament thermoplastic yarns include non-heat set thermoplastic filaments.

9. The terry article of claim 1, wherein the continuous filament thermoplastic yarns have a count in a range between about 75 denier to about 900 denier.

10. The terry article of claim 1, wherein the first set of pile yarns have a count in a range between about 6 Ne to about 60 Ne.

11. A terry article comprising:

a ground component including a plurality of ground warp yarns and a plurality of weft yarns interwoven with the plurality of ground warp yarns, a ground component including a plurality of ground warp yarns and a plurality of weft yarns interwoven with the plurality of ground warp yarns, the ground component including a lower side and an upper side opposed to the lower side along a vertical direction; and the ground component including a first side and a second side opposed to the first side along a vertical direction;

a first pile component disposed on the first side, the first pile component including a plurality of first piles; and a second pile component disposed on the second side, the second pile component including a plurality of second piles, wherein the plurality of first piles of the first pile component include 1) a first plurality of piles that extend away from the ground component along the vertical direction, the first plurality of piles formed from a first set of pile yarns comprised of natural fibers, the first plurality of piles including a first pile base located at the ground component, a first pile end spaced apart from the first pile base, and a first pile height that extends from the first pile base to the first pile end along the vertical direction; and 2) a second plurality of piles that extend away from the ground component in the vertical direction, the second plurality of piles formed from a set of continuous filament thermoplastic yarns, the second plurality of piles including a second pile base at the ground component, a second pile end spaced apart from the second pile base, and a second pile height that extends from the second pile base to the second pile end along the vertical direction, wherein the second pile height is less than the first pile height.

12. The terry article of claim 11, wherein the first plurality of piles are randomly distributed among the second plurality of piles across a length and width dimension of the pile component.

13. The terry article of claim 11, further comprising a plurality of first pile zones that include the first plurality of piles, and a second plurality of pile zones that include the second plurality of piles, wherein the first and second pile zones are visually distinct with respect to each other.

14. The terry article of claim 11, wherein the continuous filament thermoplastic yarns include non-heat set thermoplastic filaments.

15. The terry article of claim 11, wherein the continuous filament thermoplastic yarns have a count in a range between about 75 denier to about 900 denier.

16. The terry article of claim 11, wherein the first set of pile yarns have a count in a range between about 6 Ne to about 60 Ne.

17. A terry article comprising:

a ground component including a plurality of ground warp yarns and a plurality of weft yarns interwoven with the plurality of ground warp yarns, the ground component including a first side and a second side opposed to the first side along a vertical direction;

a first pile component disposed on the first side, the first pile component including a first plurality of piles that extend away from the ground component along the vertical direction, the first plurality of piles formed from a first set of pile yarns comprised of natural fibers, the first plurality of piles including a first pile base located at the ground component, a first pile end spaced apart from the first pile base, and a first pile height that extends from the first pile base to the first pile end along the vertical direction; and a second pile component disposed on the second side, the second pile component including a second plurality of piles that extend away from the ground component in the vertical direction, the second plurality of piles formed from a set of continuous filament thermoplastic yarns, the second plurality of piles including a second pile base at the ground component, a second pile end spaced apart from the second pile base, and a second pile height that extends from the second pile base to the second pile end along the vertical direction, wherein the second pile height is less than the first pile height.

18. The terry article of claim 17, wherein the continuous filament thermoplastic yarns include non-heat set thermoplastic filaments.

19. The terry article of claim 17, wherein the continuous filament thermoplastic yarns have a count in a range between about 75 denier to about 900 denier.

20. The terry article of claim 17, wherein the first set of pile yarns have a count in a range between about 6 Ne to about 60 Ne.

21. The terry article of claim 1, wherein the set continuous filament thermoplastic yarns include partially non-heat set thermoplastic filaments.

22. The terry article of claim 1, wherein at least one of the first set of pile yarns and the set of continuous filament thermoplastic yarns are plied yarns.

23. The terry article of claim 11, wherein at least one of the first set of pile yarns and the set of continuous filament thermoplastic yarns are plied yarns.

24. The terry article of claim 17, wherein at least one of the first set of pile yarns and the set of continuous filament thermoplastic yarns are plied yarns.

* * * * *